US006784877B1

(12) United States Patent
Kim et al.

(10) Patent No.: US 6,784,877 B1
(45) Date of Patent: Aug. 31, 2004

(54) IMAGE CONTROL METHOD AND APPARATUS FOR DIGITAL MONITOR

(75) Inventors: Jun Hee Kim, Seoul (KR); Han Sang Lee, Seoul (KR); Hee Gyung Yoon, Yeewang-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 580 days.

(21) Appl. No.: 09/640,688

(22) Filed: Aug. 18, 2000

(30) Foreign Application Priority Data

Aug. 19, 1999 (KR) ..... 1999-34362

(51) Int. Cl.[7] ..... G09G 5/00
(52) U.S. Cl. ..... 345/204; 345/98
(58) Field of Search ..... 356/163; 341/118; 348/511, 580; 345/204

(56) References Cited

U.S. PATENT DOCUMENTS 4,486,781 A * 12/1984 Wilmer et al. ..... 358/163
5,717,467 A 2/1998 Shiki
5,982,310 A * 11/1999 Tanaka ..... 341/118

* cited by examiner

*Primary Examiner*—Steven Saras
*Assistant Examiner*—Srilakshmi K. Kumar
(74) *Attorney, Agent, or Firm*—McKenna Long & Aldridge LLP

(57) ABSTRACT

An image control method and apparatus for a digital monitor that is capable of controlling a contrast and a color temperature in the digital monitor is disclosed. In the method, an offset control signal is produced. A digital input signal is added to the offset control signal. An added value of the digital input signal and the offset control signal is limited within a desired reference value. Accordingly, a contrast and a color temperature of the digital input signal can be controlled in the digital monitor.

9 Claims, 16 Drawing Sheets

IMAGE CONTROL METHOD AND APPARATUS FOR DIGITAL MONITOR

BACKGROUND OF THE INVENTION

1. Field of the Invention

This invention relates to a monitor, and more particularly to an image control method and apparatus that is capable of controlling a contrast and a color temperature in a digital monitor.

2. Description of the Related Art

Generally, a liquid crystal display (LCD) is one of a plat panel display device that display a picture by controlling a transmitted amount of a light beam to correspond to image signals. This LCD has advantages of a light weight, a thin thickness and a low power consumption. Owing to this, the LCD has been applied to display devices for an office automation equipment and a notebook computer as well as a monitor for a personal computer. The monitor is classified into an analog monitor and a digital monitor depending on a shape of input signals applied to the monitor from a graphic card. Such a monitor is required to control a brightness, a contrast and a color temperature in accordance with a picture display quality or as needed.

Referring to FIG. 1, an analog input signal 2 applied to an analog monitor is shown. The analog input signal 2 has an amplitude ΔVpp that is a difference between its maximum value Vph and its minimum value Vpl. The minimum value Vpl of this analog input signal 2 has a voltage difference from a zero level V0 by a direct current offset value ΔVpl_0. The zero level V0 of the analog input signal 2 is displayed into a most dark black when a liquid crystal panel of the analog monitor is a normally white type, whereas it is displayed into a most bright white when a liquid crystal panel of analog monitor is a normally black type.

In the case of an analog monitor, the brightness is controlled by adjusting the direct current offset ΔVpl_0 of the analog input signal 2. The contrast is controlled by adjusting the amplitude ΔVpp of the analog input signal 2. To this end, the analog monitor includes an amplifier 4 and an analog to digital converter (ADC) 6 connected, in series, to an input line 3 as shown in FIG. 2. The amplifier 4 amplifies the analog input signal 2 inputted via the input line 3 by its gain value and applies the amplified signal to the ADC 6. The ADC 6 converts an analog signal inputted from the amplifier 4 into a digital signal and applies the digital signal to a scaler 8. The scaler 8 converts a resolution of the digital signal from the ADC to be adaptive for a resolution of the liquid crystal panel. If a gain value of the amplifier 4 is controlled, then an amplitude ΔVpp of the analog input signal 2 in FIG. 1 is controlled to control the contrast to that extent. Also, if a direct current bias of the amplifier 4 is controlled, then the direct current offset value ΔVpl_0 of the analog input signal 2 in FIG. 1 is controlled.

The color temperature or each of red, green and blue colors can be controlled into a desired value by installing the amplifiers 4 at each input line coupled with red, green and blue analog input signals 2 as shown in FIG. 3 and controlling gain values and direct bias voltages of the amplifiers 4. In FIG. 3, Gx represents a gain value per channel, and Ox does a direct current offset value per channel.

Referring now to FIG. 4, there is shown a digital monitor that includes a transmission minimized differential signal (TDMS) receiver 16 connected to a graphic card 10 in series. The graphic card 10 is provided with a TDMS transmitter 14 connected between a graphic controller 12 and the TDMS receiver 16. The graphic controller 12 converts a graphic signal to be adaptive for a resolution of the liquid crystal panel and applies it to the TDMS transmitter 14. The TDMS transmitter 14 encodes a digital graphic signal inputted from the graphic controller 12 into a TDMS signal that is a serial-type graphic signal. The TDMS receiver 16 decodes the TDMS signal from the TDMS transmitter 14 into a parallel-type signal. Since a graphic signal applied from the graphic card 10 is encoded into a digital type to apply the same to the digital monitor as described above, it is impossible to control an amplitude ΔVpp or a direct current offset ΔVpl_0 like the analog input signal 2. Accordingly, the digital monitor is able to control the brightness by a brightness control of the back light only, but is difficult to correct the brightness, the contrast and the color temperature by controlling the input signal. In particular, the digital monitor has a problem in that correction of the contrast and the color temperature is substantially impossible.

SUMMARY OF THE INVENTION

Accordingly, it is an object of the present invention to provide an image control method and apparatus for a digital monitor that is capable of controlling a contrast and a color temperature in the digital monitor.

In order to achieve these and other objects of the invention, an image control method for a digital monitor according to one aspect of the present invention includes the steps of producing an offset control signal; adding a digital input signal to the offset control signal; and limiting an added value of the digital input signal and the offset control signal within a desired reference value.

An image control method for a digital monitor according to another aspect of the present invention includes the steps of producing an contrast control signal; multiplying a digital input signal by the contrast control signal; and limiting a multiplied value of the digital input signal and the contrast control signal within a desired reference value.

An image control method for a digital monitor according to still another aspect of the present invention includes the steps of producing an offset control signal and a contrast control signal; adding a digital input signal to the offset control signal; multiplying the digital input signal by the contrast control signal; limiting an added value of the digital input signal and the offset control signal within a desired reference value; and limiting a multiplied value of the digital input signal and the contrast control signal within a desired reference value.

An image control apparatus for a digital monitor according to still another aspect of the present invention includes control means for producing an offset control signal; a digital adder for adding a digital input signal to the offset control signal; and added value control means for limiting an added value of the digital input signal and the offset control signal within a desired reference value applied from the control means.

An image control apparatus for a digital monitor according to still another aspect of the present invention includes control means for producing a contrast control signal; a digital multiplier for multiplying a digital input signal by the offset control signal; and multiplied value control means for limiting a multiplied value of the digital input signal and the contrast control signal within a desired reference value applied from the control means.

An image control apparatus for a digital monitor according to still another aspect of the present invention includes control means for producing an offset control signal and a contrast control signal; a digital adder for adding a digital input signal to the offset control signal; a digital multiplier for multiplying the digital input signal by the offset control signal; added value control means for limiting an added value of the digital input signal and the offset control signal within a desired reference value applied from the control means; and multiplied value control means for limiting a multiplied value of the digital input signal and the contrast control signal within a desired reference value applied from the control means.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
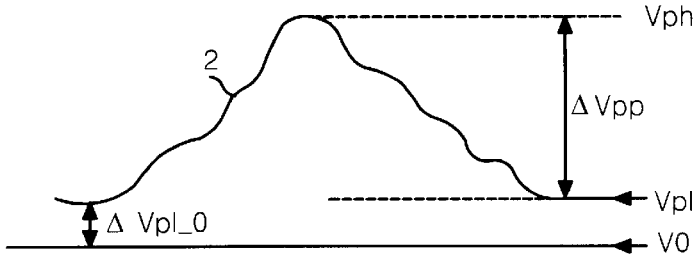
FIG.1 PRIOR ART
FIG. 1 is a waveform diagram of an analog input signal.
Figure 2:
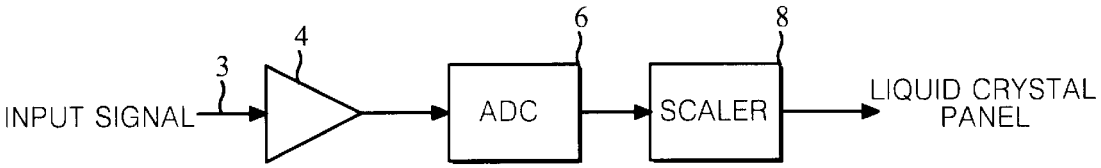
FIG.2 PRIOR ART
FIG. 2 is a block diagram showing a configuration of a analog monitor driving circuit for controlling a gain value and an offset value of the analog input signal in FIG. 1.
Figure 3:
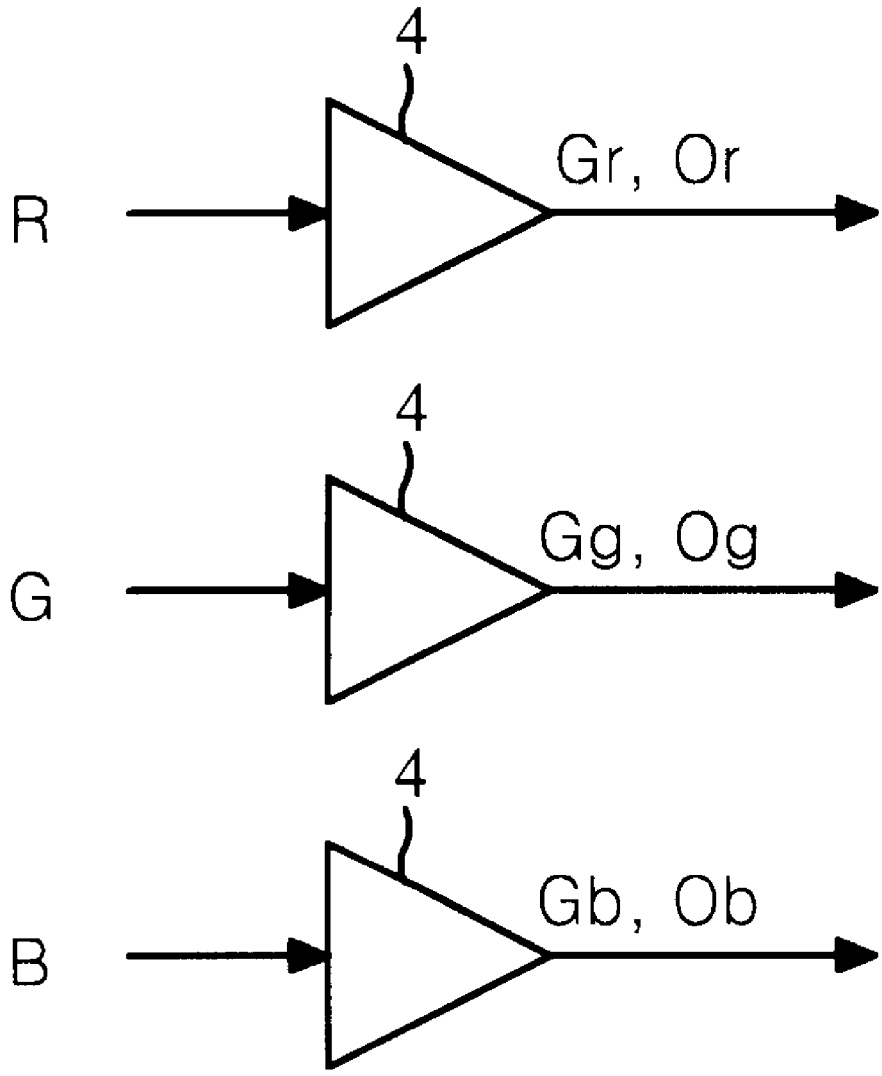
FIG. 3 PRIOR ART
FIG. 3 shows a analog monitor driving circuit for controlling a gain value and an offset value of each of red, green and blue analog input signals.
Figure 4:
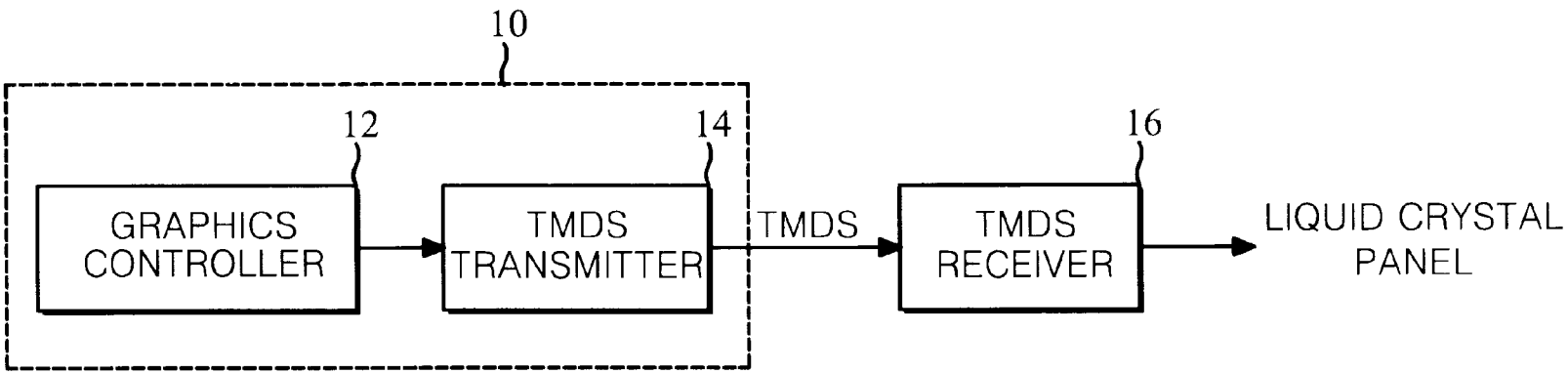
FIG. 4 PRIOR ART
FIG. 4 is a block diagram showing a configuration of a conventional digital monitor driving circuit.
Figure 5:
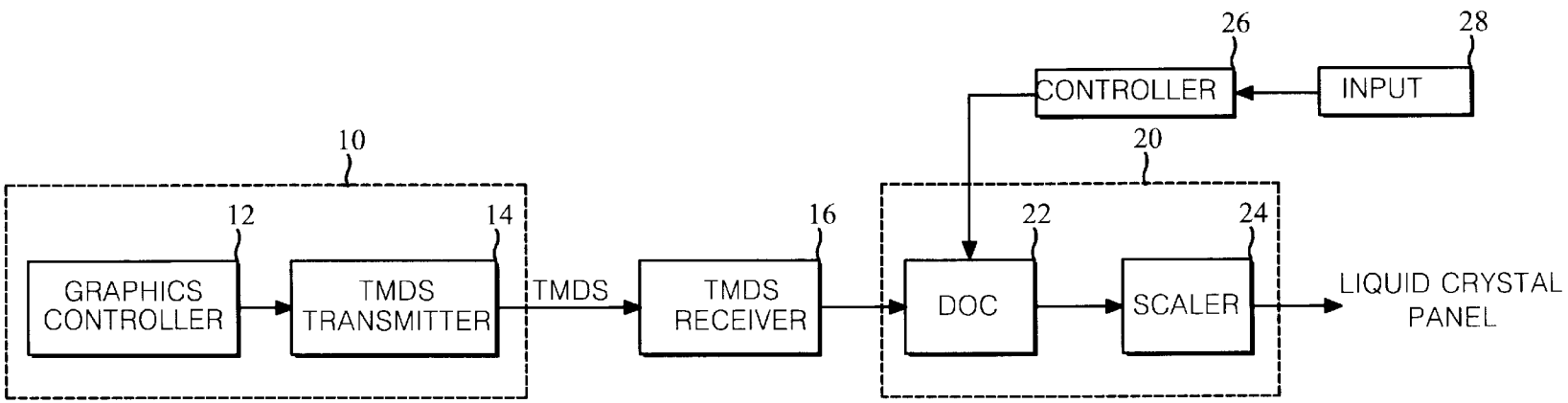
FIG. 5 is a block diagram showing a configuration of a digital monitor driving circuit according to a first embodiment of the present invention.

Referring to FIG. 5, there is shown a digital monitor according to a first embodiment of the present invention. The digital monitor includes a TDMS receiver 16, a digital offset controller (DOC) 22 and a scaler 24 connected, in series, between a graphic card 10 and a liquid crystal panel. The graphic card 10 includes a graphic controller 12 and a TDMS transmitter 14. The TDMS transmitter 14 encodes a digital graphic signal inputted from the graphic controller 12 into a TDMA signal of serial type and graphic signal type. The TDMS receiver 16 decodes the TDMA signal from the TDMA transmitter 14 into a parallel type and applies it to the DOC 22. The DOC 22 adds a parallel digital signal applied from the TDMA receiver 16 to an offset control signal applied from a controller 26 to control an offset value of the parallel digital signal.

Figure 6:
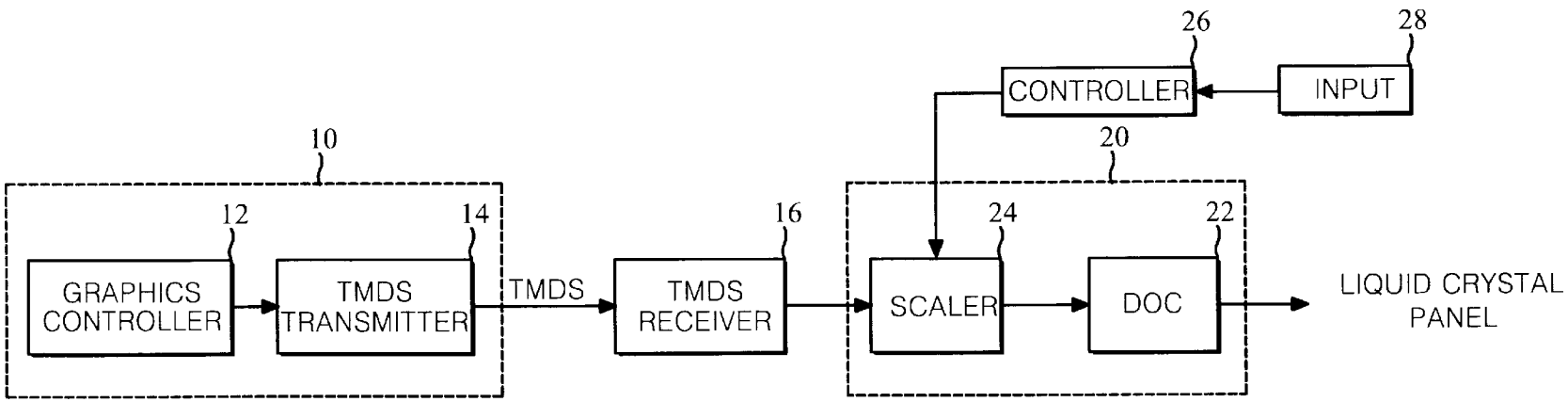
FIG. 6 is a block diagram showing that the DOC in FIG. 5 is connected to an output stage of a scaler.

Accordingly, the DOC controls the brightness and the color temperature of the parallel digital signal from the TDMA receiver 16. The controller 26 produces the offset control signal and adjusts a value of the offset control signal applied to the DOC 22 in accordance with a user's on screen display (OSD) offset control value inputted via an input 28. The scaler 24 converts a digital signal applied from the DOC 22 to be adaptive for a resolution of the digital signal applied from the DOC 22 and applies the same to the liquid crystal panel. The DOC 22 and the scaler 24 can be integrated into a single DOC/scaler chip 20. Also, the DOC 22 is installed at an input stage of the scaler 24 as shown in FIG. 5, but it may be installed at an output stage of the scaler 24 as shown in FIG. 6.

Figure 7:
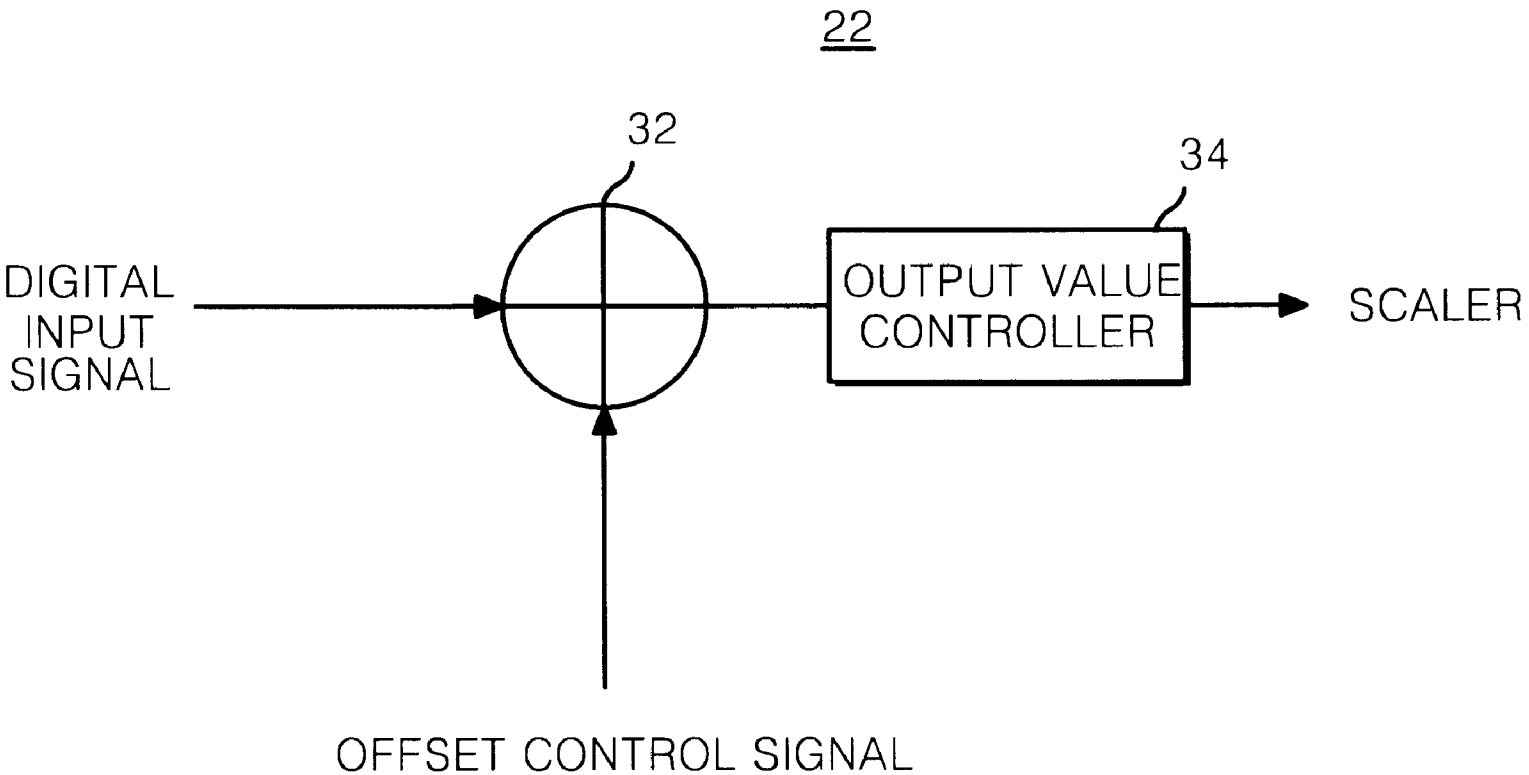
FIG. 7 is a detailed block diagram of the DOC shown in FIG. 5.

FIG. 7 is a detailed block diagram of the DOC 22 in FIG. 5. In FIG. 7, the DOC 22 includes a digital adder 32 for adding a digital input signal to an offset control signal, and an output value controller 34 for allowing a value of an output signal of the digital adder 32 not to exceed a maximum value. The digital adder 32 is commonly connected to the output terminal of the TDMA receiver 16 and the output terminal of the controller 26 to add the digital input signal from the TDMA receiver 16 to the offset control signal from the controller 26, and then applies the added signal to the output value controller 34. The output value controller 34 maintains a maximum output value of the digital adder 32 constantly such that the output value of the digital adder 32 does not exceed a maximum value set by the controller 26.

Figure 8:
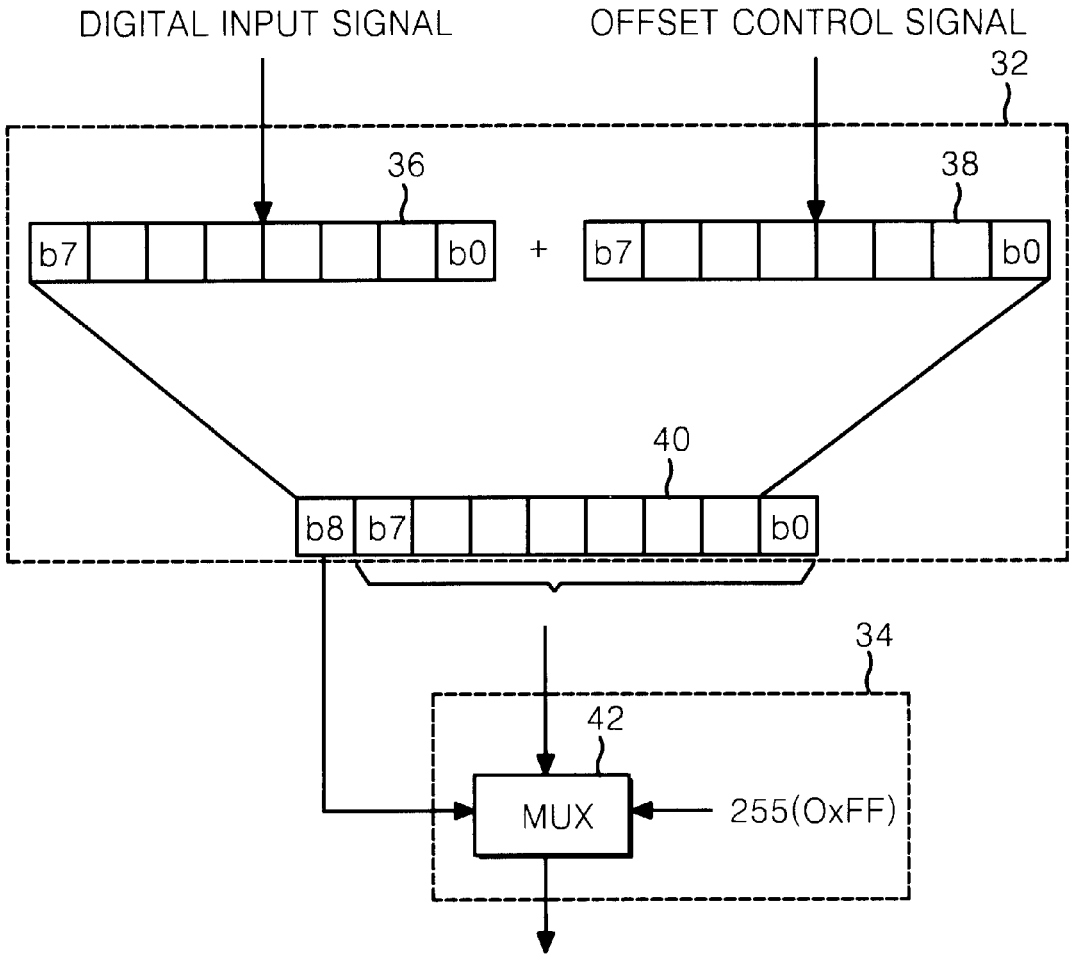
FIG. 8 is a detailed block diagram of the digital adder and the output value controller shown in FIG. 7.
Figure 9:
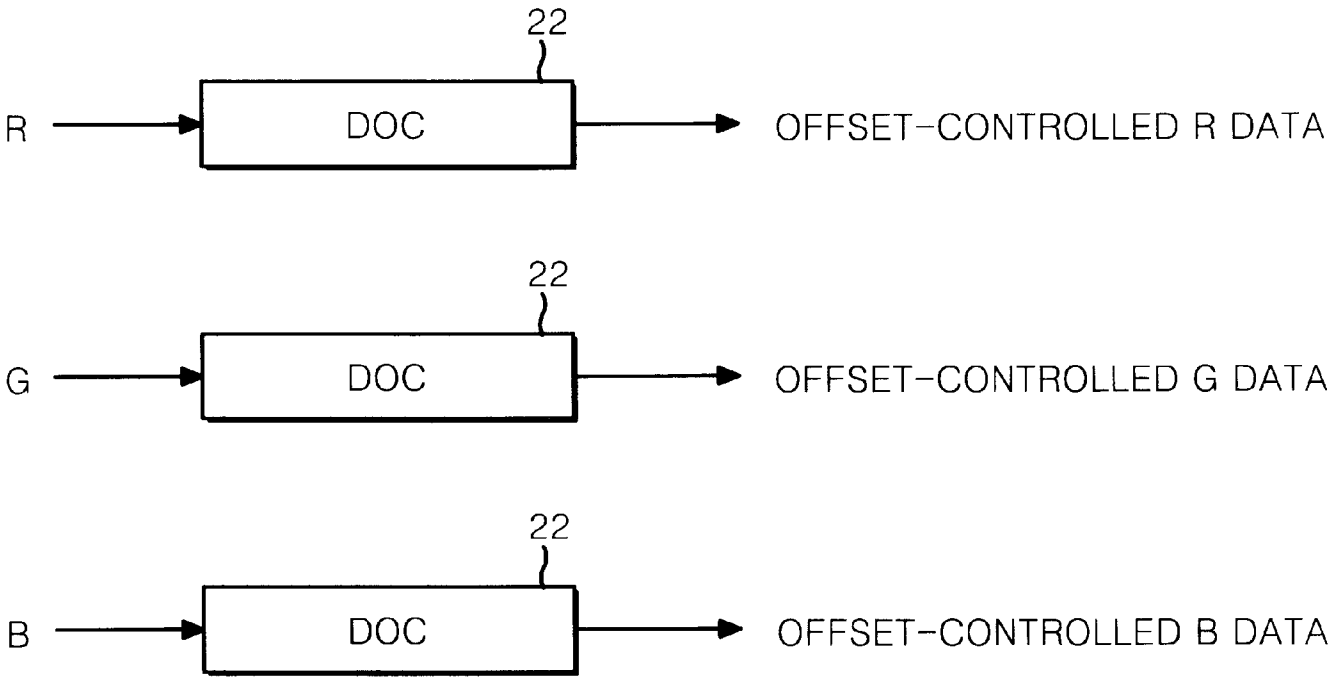
FIG. 9 is a block diagram showing a connection state of the DOC for adding each of the red, green and blue digital input signals.

FIG. 8 represents the digital adder and the output controller in FIG. 7 in detail. In FIG. 8, the digital adder 32 includes a first register 36 for storing a digital input signal, a second register 38 for storing an offset control signal, and a third register 40 for storing an added value of the digital input signal and the offset control signal. When an image is displayed at 255 gray scales, that is, when each of red, green and blue data is expressed at 8 bits (total 24 bits), red, green and blue digital data with 8 bits b0, b1, . . . , b7 are stored in the first register 36. An offset control signal with 8 bits b0, b1, . . . , b7 is stored in the second register 40. The digital data are added to the offset control signal to be stored in the third register 40. An added data with 9 bits b0, b1, . . . , b8 are stored in the third register 40 so that an overflow value from an added result of the digital data and the offset control signal can be stored.

The output value controller 34 includes a multiplexor (MUX) 43 outputting any one of the added value stored in the third register 40 and a maximum value. An overflow bit signal b8 generated at a result of adding the digital data to the offset control signal is applied to a control terminal of the MUX 42. If the overflow bit B8 is "1", then it means that an added result of the digital data and the offset control signal exceeds a maximum value of "255". On the other hand, if the overflow bit b8 is "0", then it means that an added result of the digital data and the offset control signal does not exceed the maximum value. If an overflow bit b8, that is, a most significant bit (MSB) is "1", then the MUX 42 outputs a maximum value "255(0xFF)" applied from the controller 26; whereas if the overflow bit b8 is "0", then the MUX 42 outputs the added data from the third register 40. Accordingly, the MUX 42 outputs an added result of the digital data that does not exceed the maximum value and the offset control signal. The DOC 22 is installed at each of input lines to which red(R), green(G) and blue(B) digital input signals are inputted, thereby controlling an offset value of each color.

Figure 10:
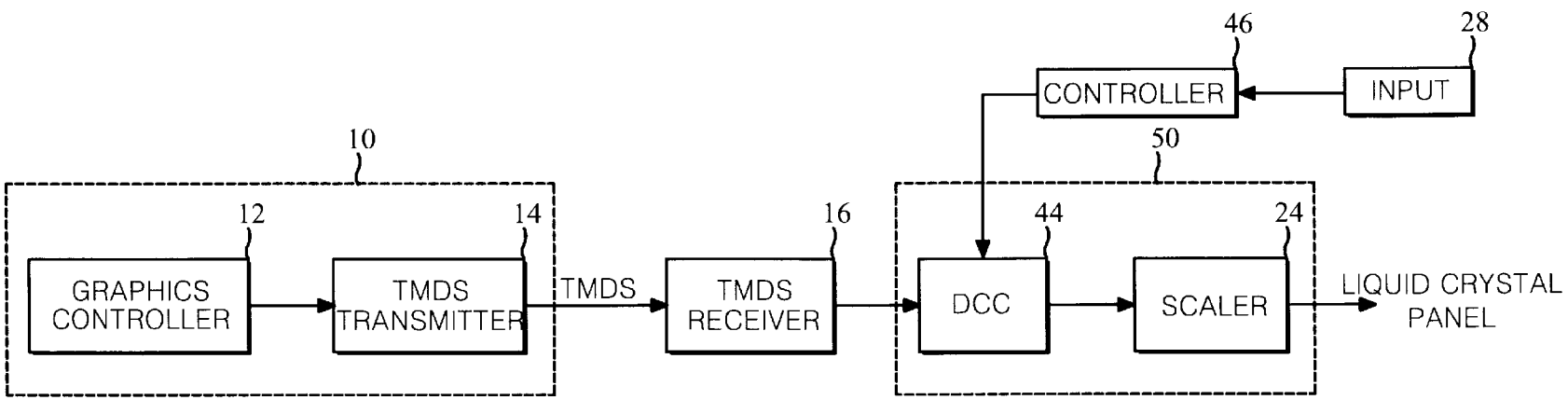
FIG. 10 is a block diagram showing a configuration of a digital monitor driving circuit according to a second embodiment of the present invention.

FIG. 10 shows a digital monitor according to a second embodiment of the present invention. In FIG. 10, elements having the same functions as those of the digital monitor in FIG. 7 will be indicated by the same reference numerals, and a detailed explanation as to these element will be omitted.

Figure 11:
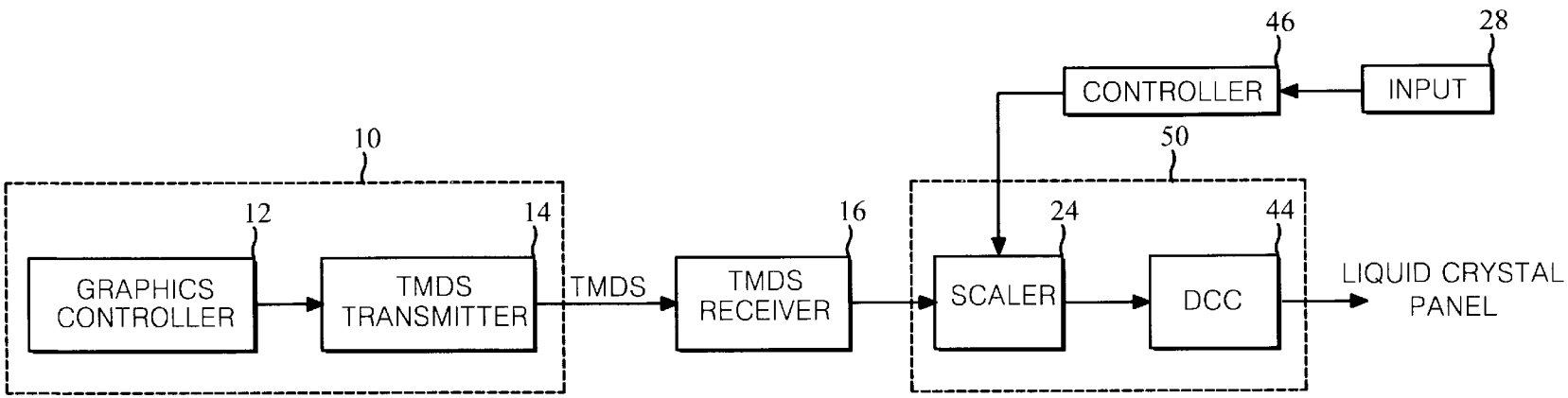
FIG. 11 is a block diagram showing that the DCC in FIG. 10 is connected to an output stage of a scaler.

Referring to FIG. 10, the digital monitor includes a TDMS receiver 16, a digital contrast controller (DCC) 44 and the scaler 24 that are connected, in series, between a graphic card 10 and a liquid crystal panel. The DCC 44 multiplies a parallel digital signal applied from the TDMS receiver 16 by a contrast control signal applied from a controller 46 to control a gain value of the parallel digital signal. The controller 46 adjusts a value of the contrast control signal applied to the DCC 44 in accordance with a OSD contrast control value inputted via an input 28. The DCC 44 and the scaler 24 can be integrated into a single DCC/scaler chip 50. Alternatively, the DCC 44 is installed at an input terminal of the scaler 24 as shown in FIG. 10, but it may be installed at an output terminal of the scaler 24 as shown in FIG. 11.

Figure 12:
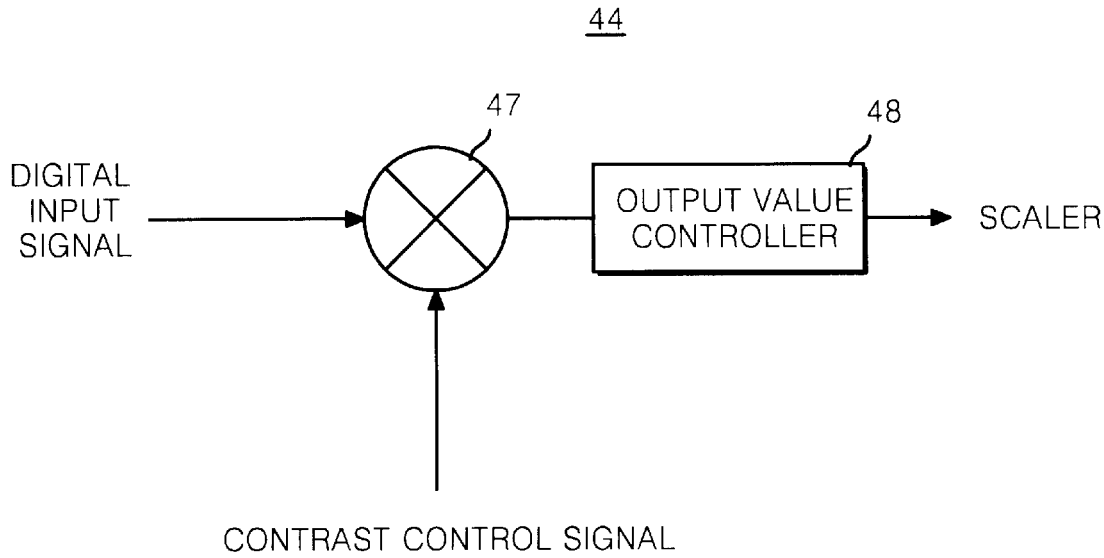
FIG. 12 is a detailed block diagram of the DCC shown in FIG. 10.

FIG. 12 represents the DCC 44 shown in FIG. 10 in detail. Referring to FIG. 12, the DCC 44 includes a digital multiplier 47 for multiplying a digital input signal by a contrast control signal, and an output value controller 48 allowing a output signal value of the digital multiplier 47 not to exceed a maximum value. The digital multiplier 47 is commonly connected to an output terminal of the TDMS receiver 16 and an output terminal of the controller 46 to multiply the digital signal from the TDMS receiver 16 by the contrast control signal from the controller 46, and then applies the same to the output value controller 48. The output value controller 48 maintains a maximum output value of the digital multiplier 47 such that an output value of the digital multiplier 47 does not exceed a maximum value set by the controller 46.

Figure 13:
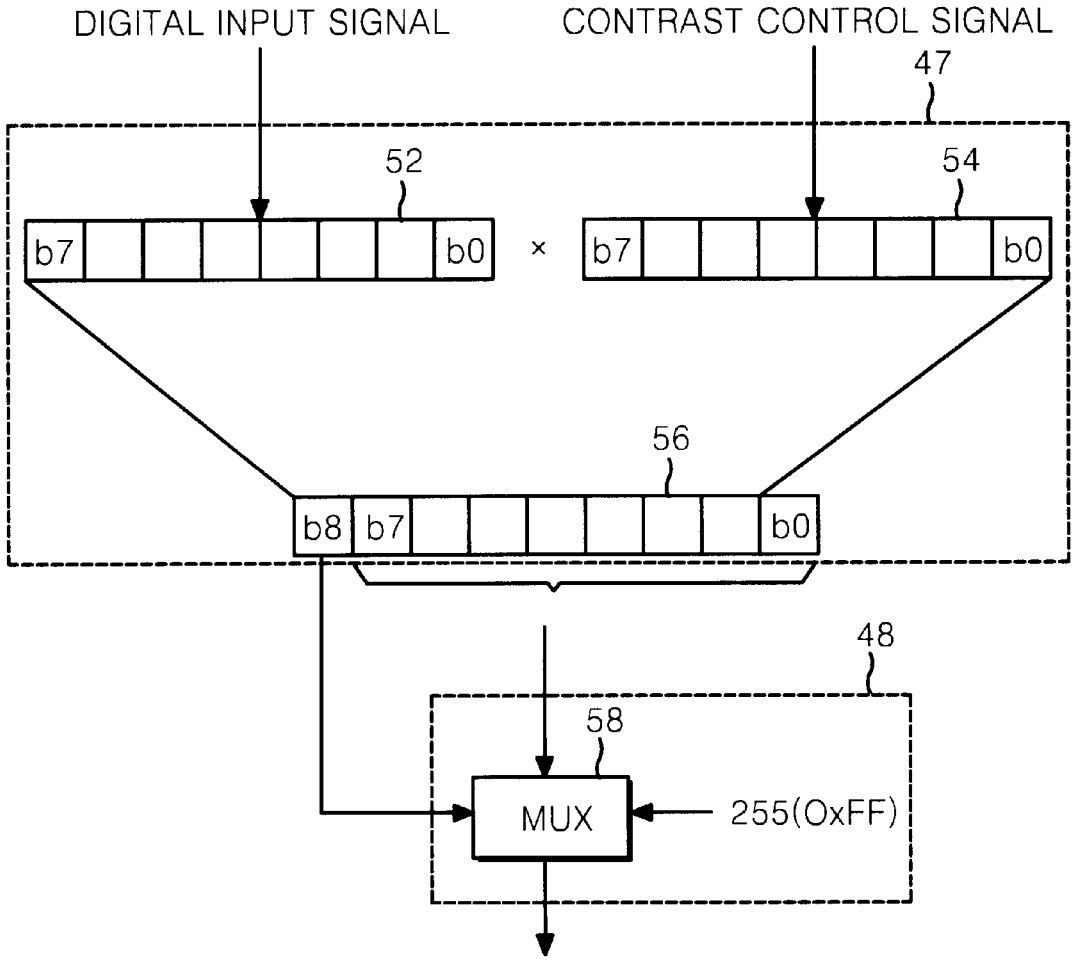
FIG. 13 is a detailed block diagram of the digital multiplier and the output value controller shown in FIG. 12.
Figure 14:
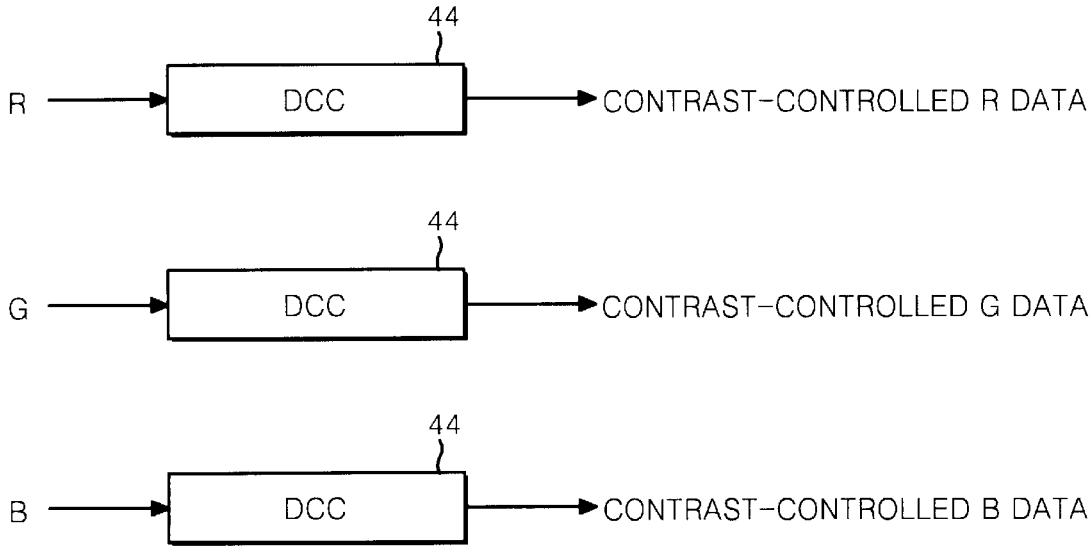
FIG. 14 is a block diagram showing a connection state of the DCC for multiplying each of the red, green and blue digital input signals.

FIG. 13 represents the digital multiplier and the output value controller shown in FIG. 12 in detail. Referring to FIG. 13, the digital multiplier 47 includes a first register 52 for storing a digital input signal, a second register 54 for storing an offset control signal, and a third register 56 for storing a multiplied value of the digital input signal and the offset control signal. When an image is displayed at 255 gray scales, red, green and blue digital data with 8 bits b0, b1, . . . , b7 are stored in the first register 52. An offset control signal with 8 bits b0, b1, . . . , b7 is stored in the second register 54. The digital data are multiplied by the offset control signal to be stored in the third register 56. A multiplied data with 9 bits b0, b1, . . . , b8 are stored in the third register 56 so that an overflow value from a multiplied result of the digital data and the offset control signal can be stored.

The output value controller 48 includes a multiplexor (MUX) 58 outputting any one of the multiplied value stored in the third register 56 and a maximum value. An overflow bit signal b8 generated at a result of multiplying the digital data by the offset control signal is applied to a control terminal of the MUX 58. If an overflow bit b8 is "1", then the MUX 58 outputs a maximum value "255(0xFF)" applied from the controller 46; whereas if the overflow bit b8 is "0", then the MUX 42 outputs the multiplied data from the third register 40. Accordingly, the MUX 58 outputs a multiplied result of the digital data that does not exceed the maximum value and the offset control signal. The DOC 44 is installed at each of input lines to which red(R), green(G) and blue(B) digital input signals are inputted, thereby controlling a contrast value of each color.

Figure 15:
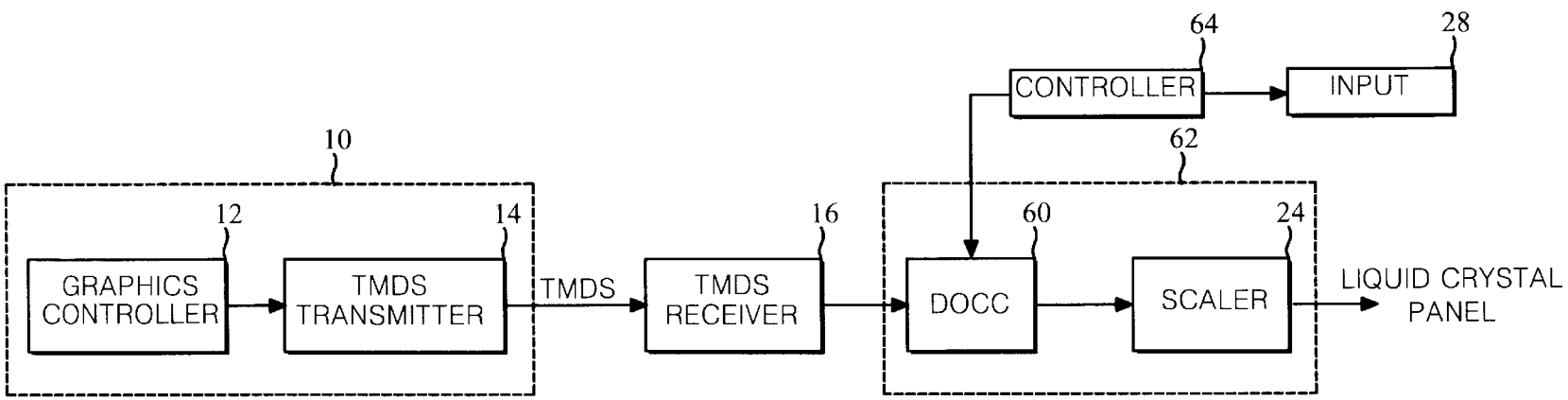
FIG. 15 is a block diagram showing a configuration of a digital monitor driving circuit according to a third embodiment of the present invention.

FIG. 15 shows a digital monitor according to a third embodiment of the present invention. In FIG. 15, elements having the same functions as those of the digital monitor in FIG. 5 and FIG. 10 will be indicated by the same reference numerals, and a detailed explanation as to these element will be omitted.

Figure 16:
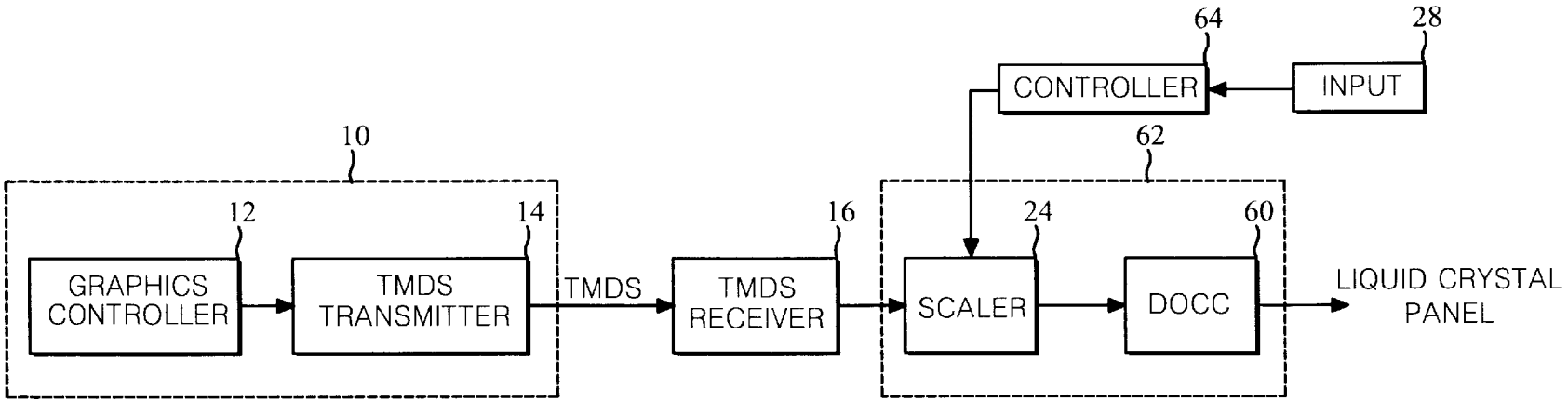
FIG. 16 is a block diagram showing that the DOCC in FIG. 15 is connected to an output stage of a scaler.

Referring to FIG. 15, the digital monitor includes a TDMS receiver 16, a digital offset/contrast controller (DOCC) 44 and the scaler 24 that are connected, in series, between a graphic card 10 and a liquid crystal panel. The DOCC 60 adds a parallel digital signal applied from the TDMS receiver 16 to a contrast control signal applied from a controller 64. Also, the DOCC 60 multiplies a parallel digital signal applied from the TDMS receiver 16 by a contrast control signal applied from the controller 64. Accordingly, the DOCC 60 controls an offset value and a gain value of the parallel digital signal applied from the TDMS receiver 16 to adjust the color temperature and the contrast. The controller 64 produces the offset control signal and the contrast control signal, and adjusts a value of the offset control signal or the contrast control signal applied to the DOCC 60 in accordance with a user's offset control signal value or contrast control signal value inputted via an input 28. The DOCC 60 and the scaler 24 can be integrated into a single DOCC/scaler chip 62. Alternatively, the DOCC 60 is installed at an input terminal of the scaler 24 as shown in FIG. 15, but it may be installed at an output terminal of the scaler 24 as shown in FIG. 16.

Figure 17:
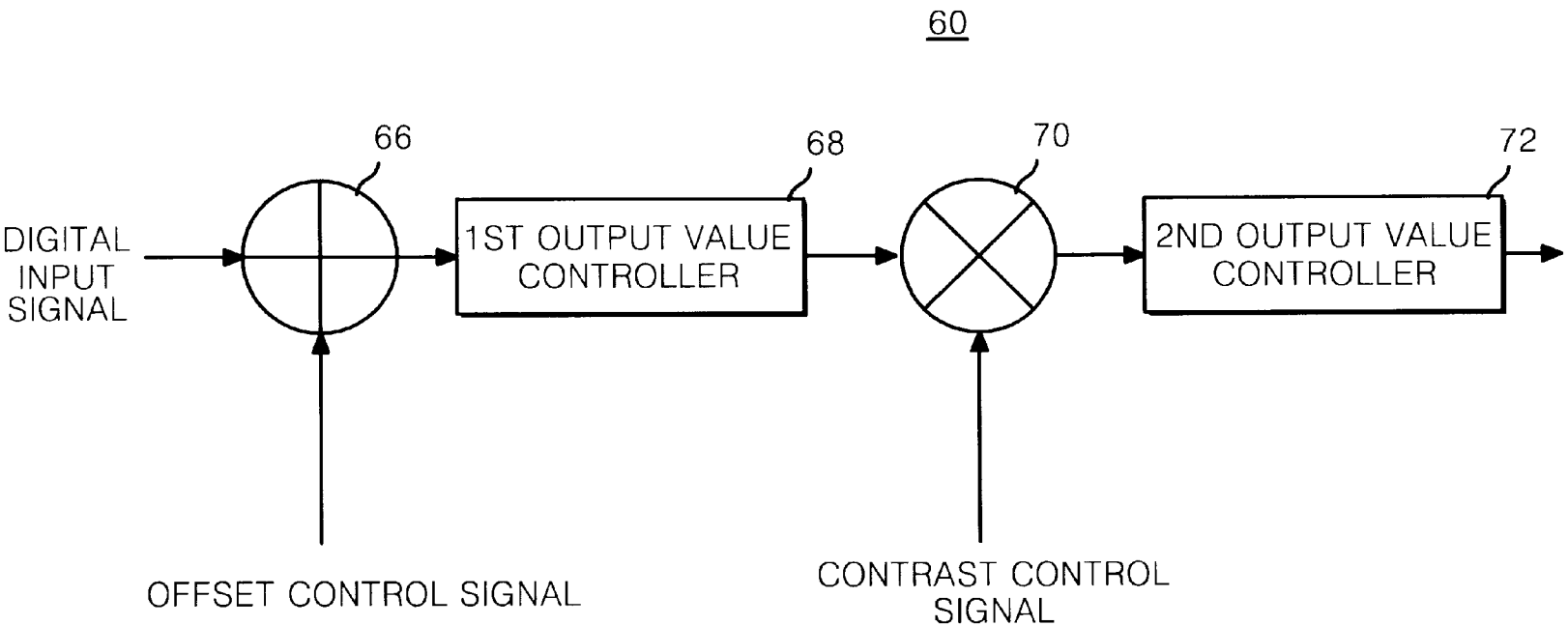
FIG. 17 is a detailed block diagram of the DOCC shown in FIG. 15.

FIG. 17 represents the DOCC 60 shown in FIG. 15 in detail. Referring to FIG. 17, the DOCC 60 includes a digital adder 66 for adding a digital input signal to an offset control signal, a first output value controller 68 allowing an output signal value of the digital adder 66 not to exceed a maximum value, a digital multiplier 70 for multiplying an output signal of the first output value controller 68 by a contrast control signal, and a second output value controller 72 allowing an output signal value of the digital multiplier 70 not to exceed the maximum value. The digital adder 66 is commonly connected to an output terminal of the TDMS receiver 16 and an output terminal of the controller 64 to add the digital signal from the TDMS receiver 16 to the contrast control signal from the controller 64, and then applies the same to the first output value controller 68. The first output value controller 68 maintains a maximum output value of the digital adder 66 constantly such that an output value of the digital adder 66 does not exceed a maximum value set by the controller 64. The digital adder 66 and the first output value controller 68 are configured in substantial similarity to those shown in FIG. 7 and FIG. 8. The digital multiplier 70 is commonly connected to an output terminal of the TDMS receiver 16 and an output terminal of the controller 64 to multiply the digital signal from the TDMS receiver 16 by the contrast control signal, and applies the multiplied signal to the second output value controller 72. The second output value controller 72 maintains a maximum output value of the digital multiplier 70 constantly such that an output value of the digital multiplier 70 does not exceed a maximum value set by the controller 64. The digital multiplier 70 and the second output value controller 72 are configured in substantial similarity to those shown in FIG. 12 and FIG. 13. The DOCC 60 configured as mentioned above is installed at each of input lines to which red(R), green(G) and blue(B) digital input signals are applied, thereby controlling a color temperature and a contrast of each color.

In addition, the DOC 22, the DCC 44 and the DOCC 60 may be buried within the graphic card 10.

As described above, according to the present invention, digital input signals are added and multiplied in the digital monitor, so that a contrast and a color temperature of the digital input signal can be controlled.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of controlling an image in a digital monitor displaying a digital input signal applied from a graphics card, said method comprising the steps of:

producing an offset control signal;

adding the digital input signal to the offset control signal to produce an added signal; and limiting a value of the added signal to be not greater than a desired reference value.

2. A method of controlling an image in a digital monitor displaying a digital input signal applied from a graphic card, said method comprising the steps of:

producing an contrast control signal;

multiplying the digital input signal by the contrast control signal; and limiting a multiplied value of the digital input signal and the contrast control signal within a desired reference value.

3. A method of controlling an image in a digital monitor displaying a digital input signal applied from a graphic card, said method comprising the steps of:

producing an offset control signal and a contrast control signal;

adding the digital input signal to the offset control signal;

multiplying the digital input signal by the contrast control signal;

limiting an added value of the digital input signal and the offset control signal within a desired reference value; and limiting a multiplied value of the digital input signal and the contrast control signal within a desired reference value.

4. An image control apparatus for a digital monitor displaying a digital input signal applied from a graphic card, said apparatus comprising:

control means for producing an offset control signal, a digital adder for adding the digital input signal to the offset control signal; and added value control means for limiting an added value of the digital input signal and the offset control signal to be not greater than a desired reference value applied from the control means.

5. The image control apparatus according to claim 4, further comprising a scaler for converting the digital input signal to be adapted to a resolution of a display panel, said scaler having an input terminal and an output terminal, and wherein the digital adder is installed at any one of the input and output terminals of the scaler, and wherein the digital adder and the scaler are integrated into a single.

6. An image control apparatus for a digital monitor displaying a digital input signal applied from a graphic card, said apparatus comprising:

control means for producing a contrast control signal;

a digital multiplier for multiplying the digital input signal by the offset control signal; and multiplied value control means for limiting a multiplied value of the digital input signal and the contrast control signal within a desired reference value applied from the control means.

7. The image control apparatus according to claim 6, wherein the digital multiplier is installed at any one of the input and output terminals of a scaler for converting the digital input signal to be adaptive for a resolution of a display panel, and the digital multiplier and the scaler are integrated into a single chip.

8. An image control apparatus for a digital monitor displaying a digital input signal applied from a graphic card, said apparatus comprising:

control means for producing an offset control signal and a contrast control signal;

a digital adder for adding the digital input signal to the offset control signal;

a digital multiplier for multiplying the digital input signal by the offset control signal;

added value control means for limiting an added value of the digital input signal and the offset control signal within a desired reference value applied from the control means; and multiplied value control means for limiting a multiplied value of the digital input signal and the contrast control signal within a desired reference value applied from the control means.

9. The image control apparatus according to claim 8, wherein the digital adder and the digital multiplier are installed at any one of the input and output terminals of a scaler for converting the digital input signal to be adaptive for a resolution of a display panel, and the digital adder, the digital multiplier and the scaler are integrated into a single chip.

* * * * *